US006247553B1

(12) United States Patent
Jones

(10) Patent No.: US 6,247,553 B1
(45) Date of Patent: Jun. 19, 2001

(54) STEP ASSEMBLY FOR T-POST, COMPONENTS THEREFOR AND METHODS OF MAKING THE SAME

(76) Inventor: Darren L. Jones, 5930 Johnston Rd., Norwood, MO (US) 65717

( * ) Notice: Subject to any disclaimer, the term of this patent is extended or adjusted under 35 U.S.C. 154(b) by 0 days.

(21) Appl. No.: 09/488,180

(22) Filed: Jan. 20, 2000

(51) Int. Cl.[7] ..... E06C 9/00
(52) U.S. Cl. ..... 182/92; 256/DIG. 5; 256/1
(58) Field of Search ..... 182/92, 90, 100, 182/189, 129; 256/DIG. 5, 1

(56) References Cited

U.S. PATENT DOCUMENTS

| | | | | |
|---|---|---|---|---|
| 2,086,280 | * | 7/1937 | Matter | 182/92 |
| 3,008,536 | * | 11/1961 | Linabery | 182/92 |
| 3,497,033 | * | 2/1970 | Herrencohl | 182/92 |
| 3,561,563 | * | 2/1971 | Harsh | 182/92 |
| 4,000,788 | | 1/1977 | Burgess et al. | 182/92 |
| 4,830,142 | | 5/1989 | McManus | 182/92 |
| 5,069,310 | * | 12/1991 | Williams | 182/92 |
| 5,407,025 | | 4/1995 | Nickel | 182/92 |
| 5,847,542 | | 1/1999 | Mason | 182/92 |

* cited by examiner

*Primary Examiner*—Alvin Chin-Shue
(74) *Attorney, Agent, or Firm*—Richard L. Marsh

(57) ABSTRACT

A step assembly comprising a pair of interengagable steps for use in climbing over a fence having T-shaped posts comprises a first step and a second step, the first step engaging the outer surface of the flat cross bar of the T-shaped post, the second step engaging the perpendicular leg of the T-shaped post wherein the first step is initially separate from the second step and is releasingly engageable thereto.

14 Claims, 4 Drawing Sheets

STEP ASSEMBLY FOR T-POST, COMPONENTS THEREFOR AND METHODS OF MAKING THE SAME

BACKGROUND OF THE INVENTION

1. Field of the Invention

This invention relates to a step assembly for use by hunters and farmers who desire to climb over a fence having T-shaped posts. Usually, a fence having T-shaped posts has several strands of barbed wire spaced vertically along the outer surface of the flat cross bar of the T-shaped post each wire resting upon a protruding lug spaced along the outer surface of the flat cross bar. Climbing the T-shaped post cannot be accomplished as the lugs are too small to be engaged by a foot and crossing such a fence by trying to slide between the barbed wires often results in torn clothing and damage to the fence.

2. Prior Art Statement

It is known to provide a "hunter's step" which has a generally T-shaped cross section to both the step and the upright leg and further has belt loop holes in extensions of the crossbar of the upright T adapted to receive a belt therethrough for wrapping around a tree or wood post. For instance, see the U.S. Pat. No. 4,000,788 issued on Jan. 4, 1977, to Burgess, et al.

It is also known to provide a stile for placing alongside a post and securing it to the post with a pliable strap affixed to slot in the tube. The stile is substantially the same length as the post and has steps on either side for scaling the stile. For instance, see the U.S. Pat. No. 4,830,142 issued on May 16, 1989 to Bernard McManus.

It is further known to provide one piece step for use on building timbers making a ladder out of a 2×4. An open U is adapted to engage the timber from one edge with teeth biting into the face of the timber. The step is a substantially square extension of one leg of the U and may be made from reinforcing bar. For instance, see U.S. Pat. No. 5,407,025 issued on Apr. 18, 1995 to Donald Nickel.

Finally, it is known to provide a step or step assembly which has a body recess for engaging a post lug. The step is placed between two post lugs and slid downwardly to engage the lug. The step may be a solid mass but may have a telescoping leg. For instance, see the U.S. Pat. No. 5,857,542 issued on Jan. 22, 1999 to Robert Mason.

SUMMARY OF THE INVENTION

The steps recited in the prior art have certain drawbacks as some are too heavy to transport, others are adaptable to wood posts only and the one for T-shaped posts is bulky for carrying in a pocket. The step assembly of this invention overcomes the shortcomings of previous post steps with a substantially flat, foldable step assembly which readily fits in a hip pocket or a jacket pocket for ready use by a hunter, farmer or another wishing to scale a barbed wire fence having spaced apart T-shaped posts. Therefore, it is an object of this invention to provide a step assembly for use in climbing over a fence comprising at least one elongated wire affixed to multiple spaced apart T-shaped posts, the step assembly comprising a first step and a second step, the first step engaging the outer surface of the flat cross bar of the T-shaped post, the second step engaging the perpendicular leg of the T-shaped post wherein the first step is initially separate from the second step and is releasingly engageable thereto.

It is a further object of this invention to provide a step assembly for use in climbing over a fence having T-shaped posts, the step assembly comprising a first step and a second step, the first step engaging the outer surface of the flat cross bar of the T-shaped post, the second step engaging the perpendicular leg of the T-shaped post wherein the first step is releasingly lockable to the second step.

It is still another object of this invention to provide a step assembly for use in climbing over a fence having T-shaped posts, the step assembly comprising a first step and a second step, the first step engaging the outer surface of the flat cross bar of the T-shaped post, the second step engaging the perpendicular leg of the T-shaped post wherein the first step is disposed above the second step.

It is yet a further object of this invention to provide a step assembly for use in climbing over a fence having T-shaped posts, the step assembly comprising a first step and a second step, the first step engaging the outer surface of the flat cross bar of the T-shaped post, the second step engaging the perpendicular leg of the T-shaped post wherein the first step is releasingly lockable to the second step and comprises a protrusion on the first step engaging a recess on the second step.

Another object of this invention to provide a step assembly for use in climbing over a fence having T-shaped posts, the step assembly comprising a first step and a second step, the first step engaging the outer surface of the flat cross bar of the T-shaped post, the second step engaging the perpendicular leg of the T-shaped post wherein the first step is hingedly affixed to the second step on a first protruding tang at one edge of the first step and an opposing protruding tang on a second edge of the second step.

Still another object of this invention to provide a step assembly for use in climbing over a fence having T-shaped posts, the step assembly comprising a first step and a second step, the first step engaging the outer surface of the flat cross bar of the T-shaped post, the second step engaging the perpendicular leg of the T-shaped post wherein the steps are disposed between adjacent protruding lugs on the T-shaped post wherein at least one the step having a portion thereof resting on a lower one of the adjacent protruding lugs.

Additionally, it is an object of this invention to provide a step assembly for use in climbing over a fence having T-shaped posts, the step assembly comprising a first step and a second step, the first step engaging the outer surface of the flat cross bar of the T-shaped post, the second step engaging the perpendicular leg of the T-shaped post wherein the first step is hingedly affixed to the second step on a first protruding tang at one edge of the first step and an opposing protruding tang on a second edge of the second step and wherein the first step is releasingly lockable to the second step on a protrusion on a second protruding tang on an edge opposite the first tang of the first step and on an edge opposite the opposing protruding tang on a first edge of the second step.

A further object of this invention is to provide a step assembly for use in climbing over a fence having T-shaped posts, the step assembly comprising one step releasably engageable with another step, the one step engaging the outer surface of the flat cross bar of the T-shaped post, the another step engaging the perpendicular leg of the T-shaped post wherein the one step is releasingly lockable to the another step.

An additional object of this invention is to provide a step assembly for use in climbing over a fence having T-shaped posts, the step assembly comprising a first step and a second step, the first step engaging the outer surface of the flat cross bar of the T-shaped post, the second step engaging the perpendicular leg of the T-shaped post wherein the first step has an upright member affixed between the first protruding tang and the second protruding tang wherein the upright member is substantially perpendicular to a stepping surface of the step.

An additional object of this invention is to provide a step assembly for use in climbing over a fence having T-shaped posts, the step assembly comprising a first step and a second step, the first step having an upright member affixed between a first protruding tang and a second protruding tang and has an aperture disposed through the upright member, the aperture engaging a protruding lug on the T-shaped post.

A further object of this invention is to provide a step assembly for use in climbing over a fence having T-shaped posts, the step assembly comprising one step releasably engageable with another step, the one step engaging the outer surface of the flat cross bar of the T-shaped post, the another step engaging the perpendicular leg of the T-shaped post wherein the one step is releasingly lockable to the another step, wherein the one step has an upright member affixed between a first protruding tang and a second protruding tang and further has an aperture disposed through the upright member the aperture engaging a protruding lug on a T-shaped post substantially in the center of the upright member and wherein the aperture is substantially aligned with the stepping surface.

A significant object of this invention is to provide a step assembly for use in climbing over a fence having T-shaped posts, the step assembly comprising a first step and a second step, the first step engaging the outer surface of the flat cross bar of the T-shaped post, the second step engaging the perpendicular leg of the T-shaped post wherein the first step is initially separate from the second step and is releasingly engageable thereto and wherein the first step has a left and right protruding tang on one end of the step, at least one of the protruding tangs having a vertical leg for engaging a corresponding vertical leg on the second step.

Finally, it is an object of this invention to provide a step assembly for use in climbing over a fence having T-shaped posts, the step assembly comprising a first step and a second step, the first step engaging the outer surface of the flat cross bar of the T-shaped post, the second step engaging the perpendicular leg of the T-shaped post wherein the first step is initially separate from the second step and is releasingly engageable thereto and wherein the first step has an upturned foot stop opposite an end wherein the first step engages the outer surface of the cross bar of the T-shaped post.

DESCRIPTION OF THE PREFERRED EMBODIMENTS

While the various features of this invention are hereinafter described and illustrated as a step assembly for use in climbing over a fence having T-shaped posts, sometimes referred to as Y-posts, T-posts used herein, the step assembly comprising a first step and a second step, the first step engaging the outer surface of the flat cross bar of the T-shaped post, the second step engaging the perpendicular leg of the T-shaped post wherein the first step is initially separate from the second step and is releasingly engageable thereto, it is to be understood that the various features of this invention can be used singly or in various combinations thereof step assembly for use in climbing over a fence having T-shaped posts, the step assembly comprising a first step and a second step, the first step engaging the outer surface of the flat cross bar of the T-shaped post, the second step engaging the perpendicular leg of the T-shaped post wherein the first step is releasingly lockable to the second step as can hereinafter be appreciated from a reading of the following description.

Figure 1:
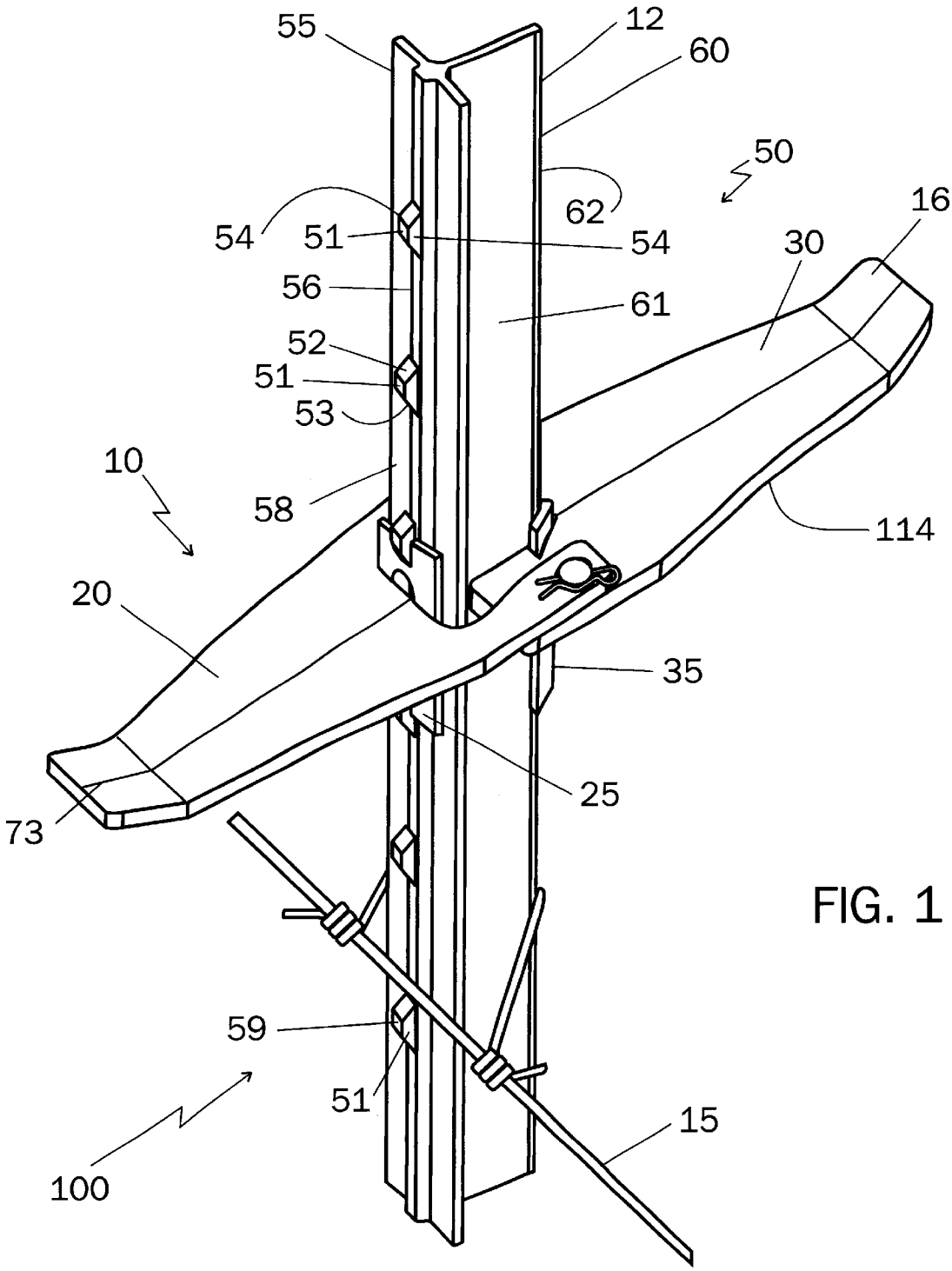
FIG. 1 is a perspective view of the preferred embodiment of the step assembly of this invention shown installed on a T-shaped post.

Referring now to FIG. 1, the step assembly, generally referred to by the numeral 10, is for use by a person in climbing over a fence, the fence generally referred to with the numeral 100. Fence 100 comprises multiple fence wires 15 affixed to T-posts 50, each fence wire 15 secured to T-post 50 above one of numerous lugs 51 spaced apart on an outer surface 56 of the crossbar 55 of T-post 50 to keep fence wire 15 from sliding vertically downwardly upon T-post 50. Step assembly 10 comprises a first step 20 and a second step 30, first step 20 engaging outer surface 56 of crossbar 55 of T-post 50 and second step 30 engaging the vertical leg 60 of T-post 50 wherein second step 30 is releasingly lockable to first step 20 as will be hereinafter fully explained. In the preferred embodiment shown in FIGS. 2 and 3, second step 30 is disposed above first step 20, second step 30 having a portion of its lower surface 114 resting upon a portion of the stepping surface 21 of first step 20. First step 20 has an openable, lockable retainer 38 protruding therefrom having a lower end 46 engaged in a retaining hole 41 disposed through one protruding tang 42 on a first side 40 of second step 30. Second step 30 is thereby releasingly lockable to first step 20 wherein lockable retainer 38 fits through retaining hole 41 on second step 30 and is removably retained therein with straight end 67 of a retainer pin 65 passing through a retaining pin hole 48 near top end 47 in lockable retainer 38, retainer pin 65 capturing hinge post 83 in a radiused loop 66 thereby affixing retainer pin 65 to hinge post 83. Though the preferred embodiment has second step 30 disposed above first step 20, first step 20 could be alternately disposed above and resting upon second step 30 as shown in FIG. 1 it being only necessary to reverse the location of lockable retainer 38 and pivot post 83, placing these elements upon second step 30 and affixing them thereto.

Referring again to FIGS. 2 and 3, first step 20 is a generally trapezoidal shaped section of flat steel sheet stock having one end, the crossbar end 22 wider than the opposite upturned end 23, the sides 70, 71 tapering from crossbar end 22 to upturned end 23. Crossbar end 22 has a recess 89 formed therein, recess 89 bounded by first protruding tang 80 and second protruding tang 75. First step 20 is creased along the centerline 64 between the tapering sides 70, 71 creating a step reinforcement 24, step reinforcement 24 resisting longitudinal bending of first step 20 when utilized on T-post 50 for scaling fence 100. Step reinforcement 24 terminates at an inside face 78 of recess 89, the terminal end of step reinforcement 24 visible as crease-V 79. In the preferred embodiment, stepping surface 21 on the top side of first step 20 comprises two surfaces 68, 69 of the same trapezoidal section of flat sheet stock angled slightly toward each other, each surface 68, 69 terminating at centerline 64. Recess 89, first protruding tang 80 and second protruding tang 75 comprise the crossbar end 22 of first step 20, crossbar end 22 further having a reinforcing support 25 affixed thereto, reinforcing support 25 being disposed perpendicular to the plane of stepping surface 21 of first step 20. Reinforcing support 25 is a flat section of steel sheet stock approximately the same width as recess 89 between protruding tangs 75 and 80 and approximately the same length as the pitch distance between two adjacent lugs 51 on T-post 50. Reinforcing support 25 has a lug aperture 26 disposed through the opposing flat faces 93, 94 of reinforcing support 25, lug aperture 26 located at the center 29 of reinforcing support 25 and being approximately the same size as the base of lug 51 on T-post 50 such that when reinforcing support 25 of first step 20 is engaged with T-post 50 over lug 51, lug aperture 26 engages lug 51 on T-post 50 substantially in the center 29 thereof. Reinforcing support 25 further has a lug slot 27 disposed inwardly from a top edge 72 and also has a lug slot 28 disposed inwardly from a base edge 39. Lug slots 27 and 28 are disposed into edges 72, 39 respectively approximately one half the size of the base of lug Si on T-post 50. Thus, when reinforcing support 25 of first step 20 is engaged with T-post 50 in space 58 between two adjacent lugs 51 as shown in FIG. 1, lug slot 28 has a portion thereof resting on and engaging a top surface 52 of a lower one of the adjacent lugs 51 and lug slot 27 is disposed around the side edges 54 and may engage a bottom angled surface 53 of an upper one of the adjacent lugs 51 on T-post 50 respectively. Of course, reinforcing support 25 may be longer than recited above thereby having more than one lug aperture 26 formed therethrough wherein any additional lug apertures 26 are spaced apart at the center 29 the same as the pitch distance between the centers 59 of two adjacent lugs 51 thereof and therefore adapted to be fitted over additional lugs 51 on T-post 50. Thus, step assembly 10 may be placed on T-post 50 with a lug 51 protruding through lug aperture 26 or may be placed upon T-post 50 with a lug 51 protruding through both lug slots 27 and 28.

Recess 89 between inside edge 90 on first protruding tang 80 and inside edge 76 on second protruding tang 75 is at least the same as the width of crossbar 55 of T-post 50 and is typically slightly wider to readily accommodate crossbar 55. First step 20 has reinforcing support 25 affixed between first protruding tang 80 and second protruding tang 75 wherein reinforcing support 25 is substantially perpendicular to stepping surface 21 of first step 20. Typically, reinforcing support 25 is welded to inside face 78 of recess 89 along flat face 93 where flat face 93 meets with stepping surface 21 as well as on a side opposite stepping surface 21 along flat face 93. As reinforcing support 25 is affixed to inside face 78 of recess 89, reinforcing support 25 lends further transverse strength to first step 20. Though reinforcing support 25 may be affixed to recess 89 at any point along flat face 93, preferably center 29 of lug aperture 26 is aligned with crease-V 79 along centerline 64 such that when aperture 26 is engaged over a lug 51 substantially in the center 29 of reinforcing support 25, center 59 of lug 51 of T-post 50 is then substantially aligned with stepping surface 21. First step 20 has a foot stop 73 on upturned end 23 opposite crossbar end 22 where first step 20 engages outer surface 56 of crossbar 55 of T-post 50. Foot stop 73 is bent upwardly along bend line 111 from stepping surface 21 approximately at a thirty degree angle from the plane of stepping surface 21 at an end 19 of step reinforcement 24 and thus adds additional strength to first step 20 to resist flattening of first step 20 when utilized on a T-post 50 for stepping over a fence wire 15 of fence 100. Foot stop 73 may additionally be creased approximately at the centerline 112 thereof in the same manner as stepping surface 21 to provide yet additional strength to foot stop 73 and first step 20.

Preferably, step assembly 10 also has second step 30 hingedly affixed to first step 20 on first protruding tang 80 at opposite side 71 of crossbar end 22 of first step 20 and on an opposing protruding tang 82 on a second side 45 of the wider T-end 32 of second step 30. Specifically, in this preferred embodiment, first step 20 has a hinge post 83 projecting from first protruding tang 80, hinge post 83 disposed through retaining hole 87 on opposing protruding tang 82 of second side 45 of second step 30 wherein hinge post 83 is affixed in a retainer hole 81 in first step 20. Hinge post 83 is generally disposed through retainer hole 81 and affixed therein by welding lower end 88 of hinge post 83 to first step 20, however, hinge post 83 may have a machine screw thread on at least one end thereof, for instance on lower end 88 wherein the machine screw thread is screwed into retainer hole 81 or passed therethrough with a retaining nut threaded thereon on either side of first step 20. As can be readily observed, hinge post 83 preferably has an enlarged head 84 wherein outer peripheral edge 86 is greater in size than hinge post 83. Enlarged head 84 has an underside surface 85 adapted to be engaged by the stepping surface 31 of second step 30 when second step 30 is hingedly assembled to first step 20. At assembly of hinge post 83 to first step 20, hinge post 83 has lower end 88 passed through retaining hole 87 in second step 30 before affixing lower end 88 in retainer hole 81 of first step 20. Thus, second step 30 is rotatably hingedly affixed to first step 20 as retaining hole 87 is smaller in diameter than enlarged head 84 retaining second step 30 to first step 20 however, retaining hole 87 is larger in diameter than hinge post 83 whereby second step 30 may be rotated freely about hinge post 83 while being retained onto first step 20 by enlarged head 84. Step assembly 10 may therefore be substantially folded in half whereby at least a portion of second step 30 overlies a portion of stepping surface 21 of first step 20- When so folded, step assembly 10 readily fits within a pocket of a jacket, coverall or jeans and be easily removed therefrom for use by the wearer of the clothing article. Particularly useful for hunters, step assembly 10 may be carried within a hunting jacket for ready use when scaling a barbed wire fence such as fence 100. Usually also used with a top of post cover such as a tennis ball cut in half, when the hunter removes step assembly 10 and the post cover from T-post 50, no scent of the hunter is left at fence 100 for detection by an animal. Farmers also find step assembly 10 quite useful when scaling of a fence 100 is required.

Those skilled in the art of assembly of hinged units will appreciate that when hinge post 83 is replaced with a threaded fastener threaded into and retained in retainer hole 81 of first step 20, the enlarged head of the threaded fastener functions the same as enlarged head 84. For instance, referring to an alternate embodiment of hinge post 83 shown spaced above hinge post 83 in FIG. 2, a threaded fastener 105 having an underside surface 109 on an enlarged hexagonal head 106 with a threaded shank 107 depending therefrom may be passed through retaining hole 87 on second step 30 and threaded into retainer hole 81 in first step 20. A jam nut 108 having a threaded hole 110 therein may be threaded onto a portion of threaded shank 107 protruding from the surface of first step opposite stepping surface 21. In yet another alternate embodiment, threaded fastener 105 may pass freely through both retaining hole 87 and retainer hole 81 with jam nut 108 threaded upon the open end of threaded shank 107. As threaded shank 107 is smaller in diameter than retaining hole 87, second step 30 may freely rotate upon threaded shank 107 such that step assembly 10 may be substantially folded in half and carried in a pocket for ready use by the carrier as hereinbefore recited.

Figure 3:
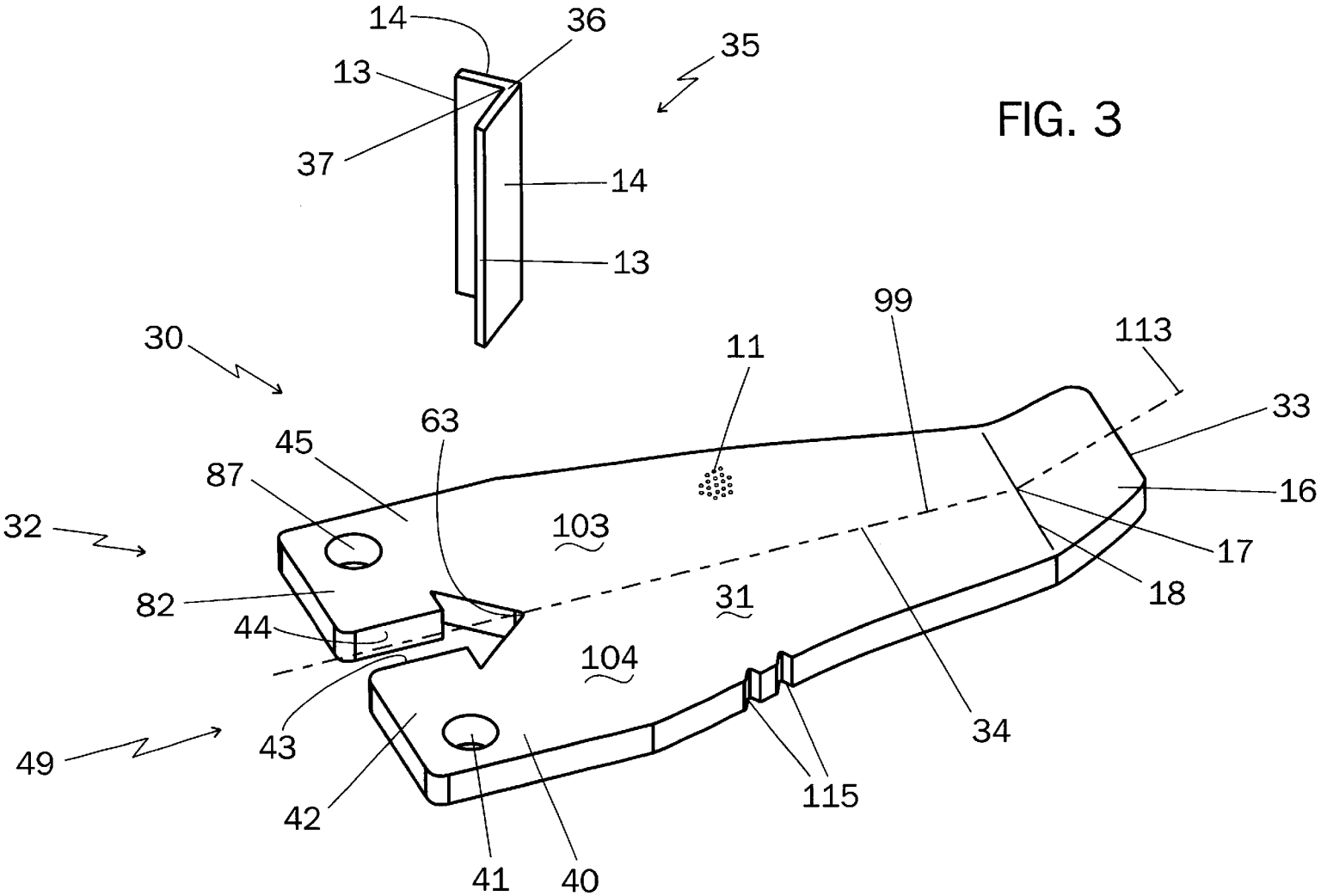
FIG. 3 is an enlarged exploded perspective view of the second step of the preferred embodiment showing the V-shaped support member for engaging the base of the T of a T-shaped post.

Referring specifically to FIG. 3, second step 30 is also a generally trapezoidal shaped section of flat steel sheet stock substantially the same size and shape as first step 20 such that second step 30 has a T-end 32 wider than the opposite upturned end 33, with sides 40, 45 tapering from T-end 32 to upturned end 33. T-end 32 has a support recess 49 formed therein, recess 49 bounded by one protruding tang 42 and opposing protruding tang 82 and T-slot sides 43, 44. T-slots 43, 44 guide vertical leg 60 of T-post 50 into engagement with a V-shaped support 35 and retain vertical leg 60 therein as T-slot sides 43, 44 are spaced apart a distance just slightly greater than the thickness of vertical leg 60 as measured between one side face 61 thereof and the opposite side face 62 thereof Second step 30 is preferably also creased along the centerline 99 between the tapering sides 40, 45 creating a step reinforcement 34, step reinforcement 34 resisting longitudinal bending of second step 30 when utilized on T-post 50. Step reinforcement 34 terminates at an apex 63 of recess 49, the terminal end of step reinforcement 24 visible at apex 63. In the preferred embodiment, a stepping surface 31 on the top side of second step 30 comprises two surfaces 103, 104 of the same trapezoidal section of flat sheet stock angled slightly toward each other wherein surfaces 103, 104 terminate at centerline 99. Recess 49, one protruding tang 42 and opposing protruding tang 82 comprise the T-end 32 of second step 30, T-end 32 further having a V-shaped support 35 affixed thereto, V-shaped support 35 being disposed perpendicular to the plane of stepping surface 31 of second step 30. V-shaped support 35 is preferably a short section of steel angle iron having a cross section approximately the same shape and size as recess 49, V-shaped support 35 affixed between one protruding tang 42 and an opposing protruding tang 82 wherein V-shaped support 35 is substantially perpendicular to stepping surface 31 of second step 30. V-shaped support 35 may also be formed from a flat section of sheet steel by forming the flat section into a U or V shape to fit within recess 49. Preferably, V-shaped support 35 is approximately twice the length as the distance between two adjacent lugs 51 on T-post 50 though V-shaped support may be longer or shorter as desired. V-shaped support 35 is adapted to engage the end 12 of vertical leg 60 opposite crossbar 55 of the vertical leg 60 of T-post 50 with end 12 captured in an inside angle 37 of V-shaped support 35. Preferably, top 36 of V-shaped support 35 is substantially aligned with stepping surface 31 of second step 30 and is affixed to second step 30 by welding along the outer surfaces 14 of the legs 13 of V-shaped support 35 where outer surfaces 14 are contiguous with surfaces 103, 104 of stepping surface 31 as well as on the side opposite stepping surface 31. As stepping surface 31 is creased along centerline 99 and V-shaped support 35 welded to stepping surface 31 along both legs 13 of V-shaped support 35, V-shaped support 35 provides additional strength to second step 30 to prevent bending of second step 30 in the longitudinal direction along centerline 99. Second step 30 also has a foot stop 16 on upturned end 33 opposite T-end 32 where second step 30 engages end 12 of vertical leg 60 opposite outer surface 56 of crossbar 55 of T-post 50. Foot stop 16 is also bent upwardly along a bend line 18 from stepping surface 31 approximately at a thirty degree angle from the plane of stepping surface 31 at an end 17 of step reinforcement 34 and thus adds additional strength to second step 30 to resist flattening of second step 30 when utilized on a T-post 50 for stepping over a fence wire 15 of fence 100. Foot stop 16 may additionally be creased approximately at the centerline 113 thereof in the same manner as stepping surface 31 to provide yet additional strength to foot stop 16 and second step 30.

At least a part of reinforcing support 25 preferably depends downwardly away from stepping surface 21 and as hereinbefore recited and is substantially perpendicular to the plane of stepping surface 21 though reinforcing support 25 could be disposed at an acute angle to stepping surface 21 angling first step 20 slightly upwardly when engaged with outer surface 56 of crossbar 55 of T-post 50. Though not necessary for use in scaling fence 100, when first step 20 is angled slightly upwardly, a foot engaged thereon will have a horizontal force component directed toward T-post 50 to better retain the foot upon first step 20. It is readily apparent that as reinforcing support 25 depends below first step 20, reinforcing support 25 keeps first step 20 substantially perpendicular to outer surface 56 and hence perpendicular to T-post 50 when first step 20 is releasingly engaged with second step 30. Likewise, V-shaped support 35 preferably depends downwardly away from stepping surface 31 and as hereinbefore recited is substantially perpendicular to the plane of stepping surface 31 though V-shaped support 35 could be disposed at an acute angle to stepping surface 31 to angle second step 30 slightly upwardly when engaged with end 12 of vertical leg 60 of T-post 50. It is readily apparent that as V-shaped support 35 depends below second step 30, V-shaped support 35 keeps second step 30 substantially perpendicular to vertical leg 60 and hence perpendicular to T-post 50 when second step 30 is releasingly engaged with first step 20. Thus as reinforcing support 25 and V-shaped support 35 engage T-post 50 below stepping surfaces 21, 31 respectively and hinge post 83 and lockable retainer 38 keep steps 20, 30 engaged together substantially at stepping surfaces 21, 31, steps 20, 30 are fully supported upon T-post 50. Furthermore, as a portion of reinforcing support 25 preferably extends above the plane of stepping surface 21 and a portion of V-shaped support 35 extends above the plane of stepping surface 31, this portion of V-shaped support 35 near top 36 firmly abuts vertical leg 60 when a load is placed upon stepping surface 21 thus preventing stepping surface 21 from tilting downwardly. Similarly, the portion of reinforcing support 25 near top 72 firmly engages front surface 56 of crossbar 55 when a load is placed upon stepping surface 31 thereby preventing stepping surface 31 from tilting downwardly. It has been found by the teachings of this invention that steps 20, 30 when engaged with hinge post 83 on protruding tangs 80, 82 and locked with lockable retainer 38 on protruding tangs 75, 42 can support a person weighing more than three hundred pounds upon a T-post 50.

In a first alternate embodiment of step assembly 10 used in climbing over a fence 100 wherein fence 100 comprises at least one elongated 15 affixed to multiple spaced apart T-posts 50, step assembly 10 comprising first step 20 and second step 30, first step 20 engaging outer surface 56 of crossbar 55 of T-post 50, second step 30 engaging vertical leg 60 of T-post 50 wherein first step 20 is initially separate from second step 30 and is releasingly engageable thereto. First step 20 is releasingly lockable to second step 30 utilizing a pair of hinge posts 83 affixed to first step 20 and engageable through retaining holes 41 and 87 in second step 30 such that lockable retainer 38 is replaced with another hinge post 83 and fixedly retained in retainer hole 77. The pair of hinge posts 83 would be identical in size and shape each having an enlarged head 84, underside surface 85 and outer peripheral edge 86. Second step 30 has elongated keyhole like slots for retaining holes 41, 87 such that hinge posts 83 may be disposed through the enlarged end of the keyhole like slots having the shank of hinge posts 83 adapted to engage the inside periphery of reduced slot of retaining holes 41, 87 on second step 30 when second step 30 is brought into engagement with T-post 50 adjacent and opposite first step 20. When engaging this alternate step assembly 10 with T-post 50, steps 20, 30 respectively are brought together having center lines 64, 99 substantially aligned such that retaining holes 41, 87 may be placed over enlarged heads 84 of each of hinge post 83. Steps 20, 30 then have up turned ends 23, 33 tilted toward each other slightly such that enlarged heads 84 move in alignment with keyhole like retaining holes 41, 87 until outer periphery 96 of heads 84 can be slipped through keyhole like retaining holes 41, 87. Once retaining holes 41, 87 are engaged over enlarged heads 84 of hinge posts 83 having lower surface 114 of second step 30 engaged with stepping surface 21 of first step 20, up-turned ends 23, 33 are moved away from T-post 50 slightly thereby engaging the shank of hinge posts 83 in the narrowed slot of the keyhole like retaining holes 41, 87. It is readily apparent here for this alternate embodiment that when step assembly 10 is removed from T-post 50, second step 30 could be nested on first step 20 wherein upturned end 33 of second step 30 would lie at up turned end 23 and hinge posts 83 engaged with retaining holes 41, 87 opposite the retaining hole 41, 87 used for engaging step assembly 10 upon T-post 50. As second step 30 readily nests upon first step 20, step assembly 10 fits easily in a pocket of a clothing article worn by the user.

Figure 2:
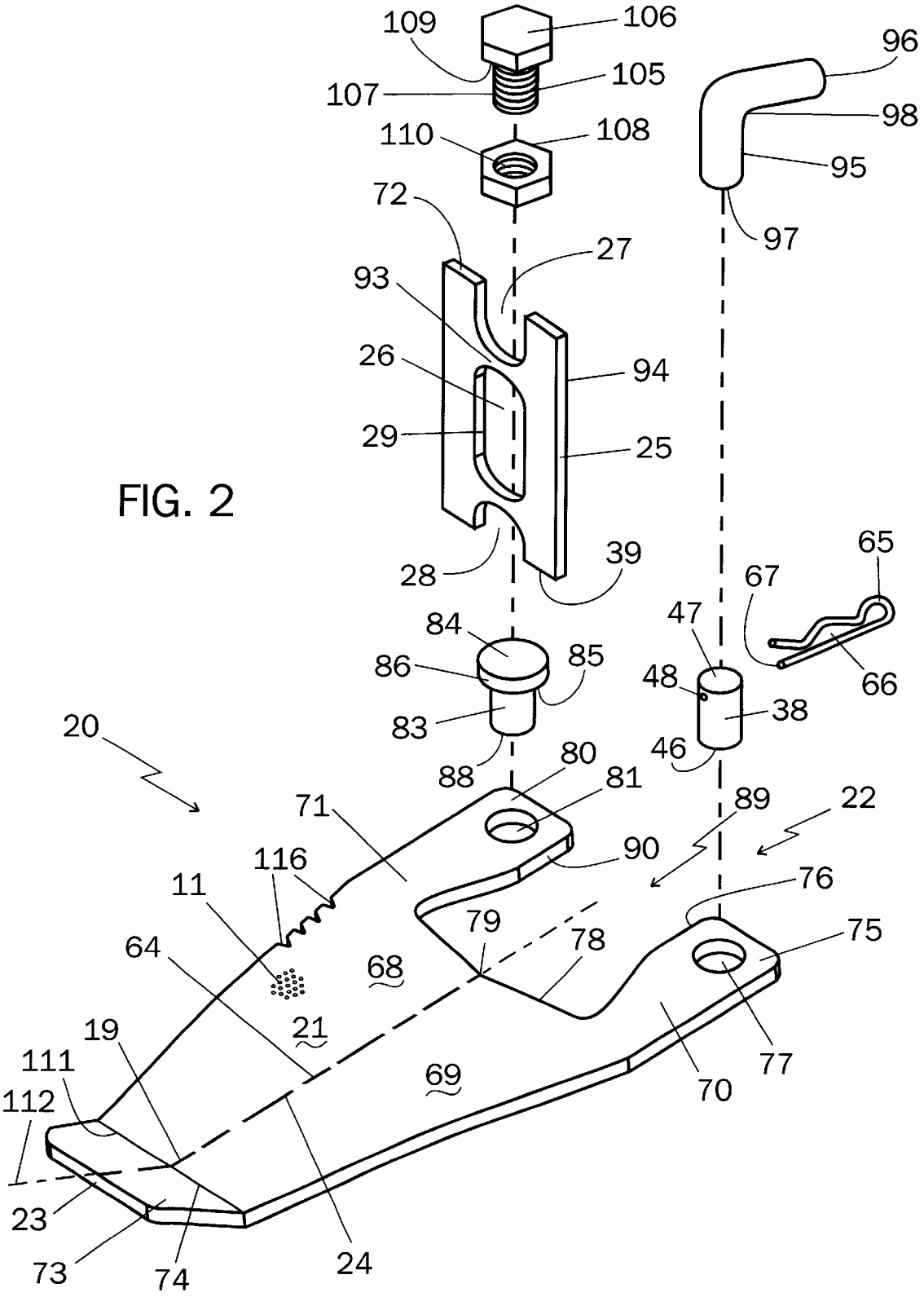
FIG. 2 is an enlarged exploded perspective view of the first step of the preferred embodiment showing the upright member for engaging the outer surface of the cross bar of a T-shaped post.

In a second alternate embodiment of step assembly 10 used in climbing over a fence 100 wherein fence 100 comprises at least one elongated 15 affixed to multiple spaced apart T-posts 50, step assembly 10 comprising first step 20 and second step 30, first step 20 engaging outer surface 56 of crossbar 55 of T-post 50, second step 30 engaging vertical leg 60 of T-post 50 wherein first step 20 is initially separate from second step 30 and is releasingly engageable thereto. First step 20 is releasingly lockable to second step 30 utilizing a pair of substantially right angled hook elements 95 affixed to first step 20 and engageable through retaining holes 41 and 87 in second step 30. Referring to FIG. 2, one hook element 95 is shown spaced above lockable retainer 38 in line with retainer hole 77 and adapted to be fixedly retained therein, it being understood that another hook element 95 would be fixedly retained in retainer hole 81. Hook elements 95 are typically portions of round steel stock bent into a right angle shape having a fixing end 97 and an open end 96, fixing end 97 and open end 96 lying in substantially perpendicular planes. Between ends 97 and 96 is a capturing curve 98 adapted to engage the inside periphery of retaining holes 41, 87 on second step 30 when second step 30 is brought into engagement with T-post 50 adjacent and opposite first step 20. When engaging this alternate step assembly 10 with T-post 50, stepping surfaces 21, 31 of steps 20, 30 respectively are disposed upwardly at approximately a right angle such that retaining holes 41, 87 may be placed over open end 96 of each of hook elements 95 fixedly retained in retainer holes 77, 81 in first step 20. Once retaining holes 41, 87 are engaged over open ends 96 of hook elements 95, first step 20 and second step 30 are lowered into engagement with T-post 50 wherein reinforcing support 25 and V-shaped support 35 engage outer surface 56 of crossbar 55 and end 12 of vertical leg 60 respectively. In this alternate embodiment, reinforcing support 25 is preferably affixed to recess 89 with top edge 72 substantially aligned with stepping surface 21 of first step 20 and top 36 of V-shaped support 35 substantially aligned with stepping surface 31 on second step 30. It is readily apparent here for this alternate embodiment that when step assembly 10 is removed from T-post 50, second step 30 could be nested within first step 20 wherein upturned end 33 of second step 30 would lie between hook elements 95 with stepping surface 21 facing stepping surface 31 such that these steps 20, 30 would readily fit in a pocket of a clothing article worn by the user. Although hook elements 95 have been described as being affixed to retainer holes 77, 81 in first step 20, hook elements 95 could be as easily affixed in retaining holes 41, 87 in second step 30 and adapted to be releasably engaged with retainer holes 77, 81 in first step 20 however, the diameters of retainer holes 77, 81 would be slightly larger than the diameter of hook elements 95 while retaining holes 41, 87 would be initially made approximately the same size as hook elements 95. In this embodiment, hook elements 95 are welded into retainer holes 77, 81 with open ends 96 projecting toward upturned end 23 and overlying a minor portion of stepping surface 21.

Figure 4:
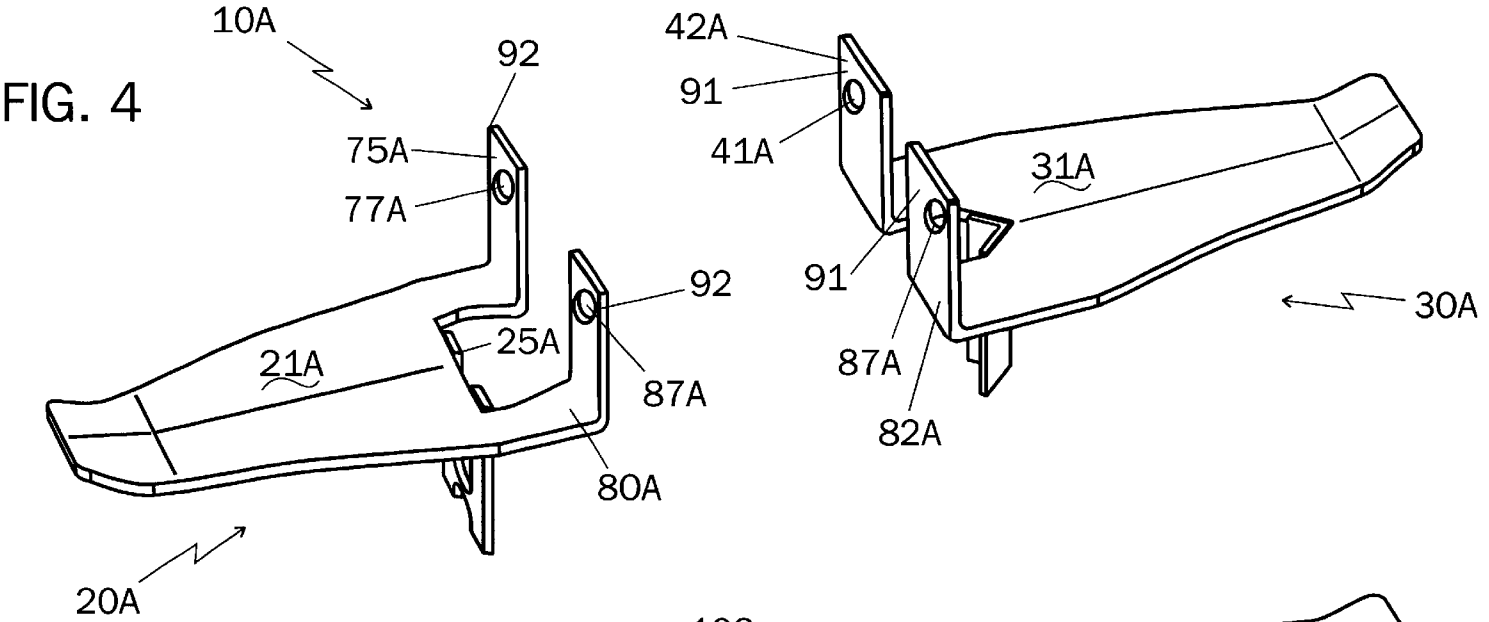
FIG. 4 is a perspective view of an alternate embodiment of the step assembly of this invention showing one step separated from another step.

In another alternate embodiment shown in FIG. 4, step assembly 10A for use in climbing over a fence 100 wherein fence 100 comprises at least one elongated 15 affixed to multiple spaced apart T-posts 50, step assembly 10 comprising first step 20A and second step 30A, first step 20A engaging outer surface 56 of crossbar 55 of T-post 50, second step 30A engaging vertical leg 60 of T-post 50 and wherein first step 20A is initially separate from second step 30A. First step 20A has a left 75A and right 80A protruding tang on crossbar end 22A of first step 20A, at least one of protruding tangs 75A, 80A having a vertical portion 91 for engaging a corresponding vertical portion 92 on second step 30A. Construction of steps 20A, 30A is substantially the same as construction of steps 20, 30 except at least one protruding tang 42A, 82A of second step 30A and at least one protruding tang 75A, 80A of first step 20A is longer than these corresponding tangs in the preferred embodiment such that a vertical portion 91, 92 may be provided thereon. For instance, in FIG. 4 there is shown a vertical portion 91 on each of protruding tangs 42A, 82A of second step 30A and a vertical portion 92 on each of protruding tangs 75A, 80A of first step 20A. Vertical portions 91, 92 are shown as projecting upwardly from steps 30A, 20A respectively, it being understood that these vertical portions 91, 92 may extend downwardly as well or that one vertical portion 91 or 92 may extend upwardly from one tang while the other vertical portion 91 may extend downwardly from the other tang as long as the vertical portions 91, 92 to be mated together lie in the same direction when step assembly 10A is engaged around T-post 50 such that a fastener may be placed through mating retainer holes in each of vertical portions 91, 92. FIG. 4 shows vertical portions 91, 92 on all protruding tangs 42A, 75A, 80A, 82A though one pair of opposing tangs, for instance 80A, 75A could be flat tangs as are tangs 80, 75 of the preferred embodiment hereinbefore described wherein hinge post 83 is passed through retaining hole 87A and affixed in retainer hole 81A thereby rotatably hingedly fixing second step 30A to first step 20A. Generally in this embodiment, protruding tang 42A has vertical portion 91 extending upwardly from second step 30A and has retaining hole 41A disposed therethrough for accepting lockable retainer 38 therein wherein lockable retainer 38 may be fixedly retained in retaining hole 41A or may be adapted to be passed therethrough. Retaining hole 41A on vertical portion 91 is aligned with retainer hole 77A disposed through a mating vertical portion 92A on second protruding tang 75A of first step 20A such that first step 20A may be releasably fixed to second step 30A with lockable retainer 38 and retainer pin 65. Likewise, protruding tang 82A of second step 30A has a vertical portion 91 extending upwardly from second step 30A and has retaining hole 87A disposed therethrough for accepting lockable retainer 38 therein. Retaining hole 87A is aligned with retainer hole 81A in vertical portion 92 of first protruding tang 80A of first step 20A, wherein second step 30A may be releasably joined to first step 20A with lockable retainer 38 and retainer pin 65. Though lockable retainer 38 is recited as being used with this alternate embodiment, it is understood that threaded fasteners 105 could be passed through the aligning retainer holes 41A, 77A and 81A, 87A with nuts 108 threaded upon the threaded shanks 107 thereof after assembling first step 20A to second step 30A around T-post 50. Alternately, retaining holes 41A, 87A may have a threaded stud fixedly retained therein and projecting therefrom for being passed through retainer holes 77A, 81A, these threaded studs also having a threaded shank 107 for accepting a nut 108 thereon. Vertical portions 92 may be longer than vertical portions 91 such that first step 20A may be disposed at a vertical location spaced below second step 30A though the plane of stepping surface 21A of first step 20A is substantially on the same plane as stepping surface 31A of second step 30A.

Figure 5:
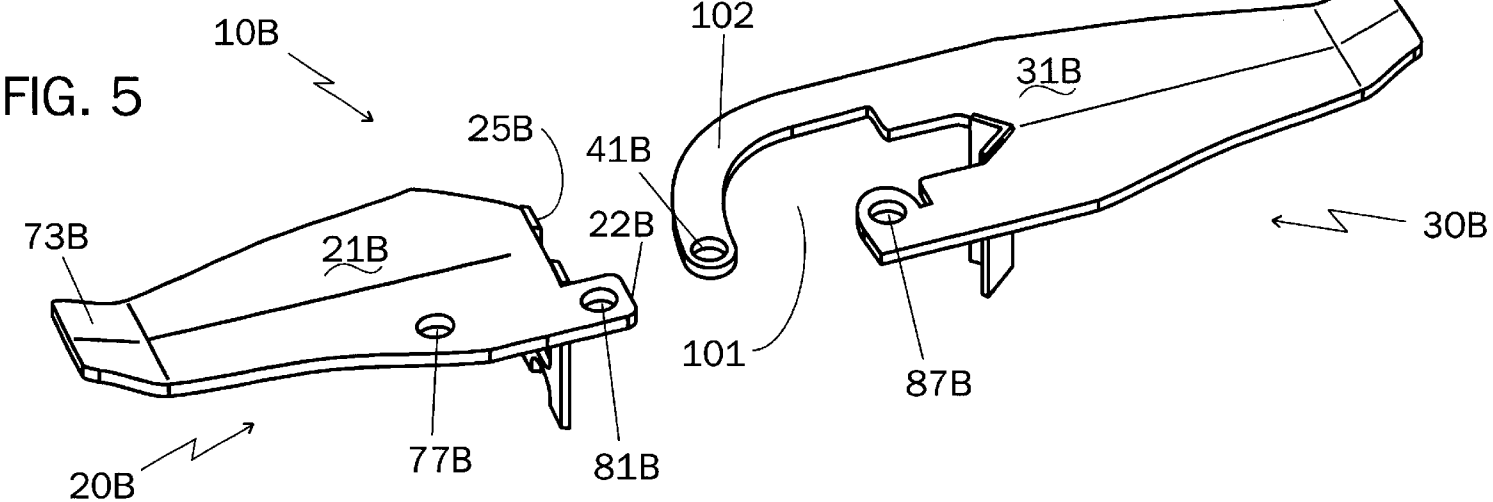
FIG. 5 is a perspective view of another alternate embodiment of the step assembly of this invention showing one step separated from another step.

In yet another alternate embodiment as shown in FIG. 5, step assembly 10B for use in climbing over a fence 100 wherein fence 100 comprises at least one elongated 15 affixed to multiple spaced apart T-posts 50, step assembly 10B has one step 20B releasably engageable with another step 30B, one step 20B engaging outer surface 56 of crossbar 55 of T-post 50 and another step 30B engaging vertical leg 60 of T-post 50. In this embodiment, step 20B is also a generally trapezoidal shaped piece of metal flat stock much like step 20 of the preferred embodiment having an upturned end comprising foot stop 73B opposite crossbar end 22B adapted to engage outer surface 56 of T-post 50, however, reinforcing support 25B is affixed to a substantially flat crossbar end 22B of step 20B. Reinforcing support 25B depends downwardly from step 20B in the same manner as reinforcing support 25 of the preferred embodiment but as reinforcing support 25B is at flat crossbar end 22B, hinge post 83 is disposed through retainer hole 81B outside of outer surface 56 of T-post 50 rather than alongside one side face 61 of vertical leg 60 as in the preferred embodiment recited above. Also as another step 30B has an elongated curved tang 102 adapted to reach around T-post 50 through curved slot 101 with retaining hole 41B disposed through curved tang 102 near the end thereof, lockable retainer 38 may be affixed to one step 20B on the stepping surface 21B thereof In this alternate embodiment though, lockable retainer 38 is affixed in retaining hole 41B and depends downwardly therefrom and engages one step 20B through retainer hole 77B. It is apparent here that the diameters of retainer holes 41B and 77B be reversed from the diameters required in the preferred embodiment. Similarly, hinge post 83 may be affixed to retaining hole 87B and passed through retainer hole 81B to keep both hinge post 83 and lockable retainer 38 on the same step, in this embodiment on another step 30B. Construction of steps 20B and 30B is similar to the construction of steps 20, 30 of the preferred embodiment though one step 20B is rotatably hingedly affixed to another step 30B and is adapted to rotate around hinge post 83 on another step 30B such that a portion of one step 20B overlies stepping surface 31B when step assembly 10B is unlocked from T-post 50 and folded in half.

In each of step assemblies 10, 10A, 10B recited above, a coating 11 covers at least the stepping surface 21, 31 of steps 20, 20A, 20B and 30, 30A, 30B respectively. Coating 11 is shown in FIGS. 2 and 3 on a minor portion of stepping surfaces 21, 31 as stippling, it being understood that coating 11 covers at least the mating surfaces where first step 20 comes in contact with second step 30 when assembled to T-post 50 or when folded in half Coating 11 may cover the entirety of first step 20 and second step 30 and may be a rubber dip coating, a powder coating, an adhesive containing a grit or any other coating utilized with steel plating. Preferably, coating 11 prevents steps 20, 30 from producing a sound when brought together either when disassembling for folding or for assembling around T-post 50 or while being carried by the user in a pocket or pouch. A rubber dip coating having a grit mixed therein has been found to be particularly advantageous as the rubber dip coating deadens any sound made when the steps are brought together while the grit mixed therein provides additional friction for stepping upon stepping surfaces 21, 31. In addition to coating 11, sides 70, 71, 40, 45 may have additional frictional aids made a part thereof For instance, the peripheral edges of sides 40, 45, 70, 71 could be serrated by providing V-shaped notches 115, 116 along at least a portion thereof to assist in engaging the sole of the wearer's field boot. The sound deadening qualities of coating 11 on step assemblies 10, 10A, 10B is particularly advantageous to hunters to provide for noise reduction while stalking game.

In each of the steps 20, 20A, 20B, 30, 30A, 30B and the alternates described therewith, the length of the respective stepping surfaces 21, 21A, 21B, 31, 31A, 31B as measured from flat face 93 of reinforcing support 25 on first step 20 to bend line 111 on stepping surface 21 or from open end of legs 13 of V-shaped support 35 to bend line 18 on second step 30 is at least the width of a man's field boot and is therefore about four inches. Of course, step assembly 10 may be made to any size to accommodate the shoe or boot size of a particular user.

Steps 20, 30 have been hereinbefore described as comprising a single piece of flat sheet metal stock bent into the particular configuration described however, it is fully understood that each side 70, 71, foot stop 73 and reinforcing support 25 of first step 20 or each side 103, 104, foot stop 16 and each side 14 of reinforcing support 35 may be initially made as separate pieces and thereafter welded together into the configuration hereinbefore recited. For instance, sides 70, 71 could be stamped from a single die, reversed and angled slightly upwardly toward each other and welded along centerline 64 to form step reinforcement 24. Thereafter, reinforcing support 25 may be welded to these two sides 69, 69 in recess 89 in the same manner as hereinbefore described. Upturned end 23 is then disposed at an angle to the plane of stepping surface 21 and welded thereto along bend line 111 to complete formation of first step 20, it being readily understood that second step 30 may be manufactured in a similar manner.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A step assembly removable affixed to a T-shaped post for use in climbing over a fence, said fence comprising at least one elongated wire affixed to a multiple of said T-shaped posts, said step assembly comprising a first step and a second step, said first step engaging an outer surface of a flat cross bar of said T-shaped post, said second step engaging a vertical leg of said T-shaped post wherein said second step is releasingly lockable to said first step wherein said, first step is hingedly affixed to said second step on a first protruding tang on one side of a cross bar end of said first step and an opposing protruding tang on a second side of a T end of said second step.

2. A step assembly as recited in claim 1 wherein said second step is disposed above said first step.

3. A step assembly as recited in claim 1 wherein said first step comprises a openable, lockable retainer on said first step releasably engaged a retaining hole in said second step.

4. A step assembly as recited in claim 1 wherein said first step releasingly lockable to said second step comprises a hinge post on said first protruding tang, said hinge post disposed through a hinge hole on said opposing protruding tang of a second side of said second step wherein said hinge post is affixed in a retaining hole in said first step.

5. A step assembly as recited in claim 4 wherein said first step has an upright member affixed between said first protruding tang and a second protruding tang wherein said upright member is substantially perpendicular to a stepping surface of said first step.

6. A step assembly as recited in claim 5 wherein said upright member has a lug aperture disposed through said upright member, said aperture engaging one protruding lug on said T-shaped post.

7. A step assembly as recited in claim 5 wherein said upright member has a slot disposed through the base of said upright member, said slot engaging a protruding lug on said T-shaped post.

8. A step assembly as recited in claim 6 wherein said aperture engages said protruding lug substantially in the center of said upright member.

9. A step assembly as recited in claim 6 wherein said aperture engages said protruding lug substantially in the center of said upright member wherein the center of said lug is substantially aligned with said stepping surface of said first step.

10. A step assembly as recited in claim 5 wherein said steps are disposed between adjacent protruding lugs on said T-shaped post wherein a lug slot in the base of said upright member of said step engages a top surface of a lower one of said adjacent protruding lugs.

11. A step assembly as in claim 1 wherein said first step has a foot stop on an upturned end opposite an end where said first step engages said outer surface of said crossbar of said T-post.

12. A step assembly as in claim 2 wherein said second step has a foot stop on an upturned end opposite an end where said second step engages said vertical leg of said T-post.

13. A step assembly as recited in claim 2 wherein said second step has an V-shaped support affixed between a one protruding tang and said opposing protruding tang wherein said V-shaped support is substantially perpendicular to a stepping surface of said second step.

14. A step assembly as in claim 13 wherein said V-shaped support captures the end of said vertical leg opposite said crossbar of said T-post in an inside angle of said V-shaped support.

* * * * *